US006819201B2

(12) United States Patent
Jain

(10) Patent No.: US 6,819,201 B2
(45) Date of Patent: Nov. 16, 2004

(54) BALANCED HIGH ISOLATION FAST STATE TRANSITIONING SWITCH APPARATUS

(75) Inventor: Nitin Jain, San Diego, CA (US)

(73) Assignee: M/A-Com, Lowell, MA (US)

( * ) Notice: Subject to any disclaimer, the term of this patent is extended or adjusted under 35 U.S.C. 154(b) by 85 days.

(21) Appl. No.: 10/199,699

(22) Filed: Jul. 19, 2002

(65) Prior Publication Data

US 2004/0012459 A1 Jan. 22, 2004

(51) Int. Cl.[7] ..... H01P 1/10

(52) U.S. Cl. ..... 333/104; 333/2; 333/4; 333/5; 333/103; 333/262

(58) Field of Search ..... 333/103, 104, 333/262, 4, 5

(56) References Cited

U.S. PATENT DOCUMENTS 4,916,410 A * 4/1990 Littlefield ..... 330/295
5,159,296 A * 10/1992 Nelson ..... 333/103
5,170,139 A * 12/1992 Nelson ..... 333/103
5,440,283 A * 8/1995 Nendza ..... 333/262
5,883,541 A * 3/1999 Tahara et al. ..... 327/434

* cited by examiner

*Primary Examiner*—Michael Tokar
*Assistant Examiner*—Khai M. Nguyen

(57) ABSTRACT

A high speed switching apparatus comprises first and second parallel balanced lines each directed from an input line end to an output line end and adapted to receive equal and opposite currents to provide balanced operation. Third and fourth parallel balanced lines are spaced apart one from the other and each directed from an input line end to an output line end and adapted to receive equal and opposite currents to provide balanced operation. A first switch is coupled between the output end of the first line and the input end of the third line, and operative in a first high impedance off state and a second low impedance on state. A second switch is coupled between the output end of the second line and the input end of the fourth line, and operative in a first high impedance off state and a second low impedance on state. A switch driver is coupled to the first and second switches to operate the switches in the off or on state according to a control signal applied to the driver, to control propagation of signals on the first and second lines to the third and fourth lines.

23 Claims, 8 Drawing Sheets

BALANCED HIGH ISOLATION FAST STATE TRANSITIONING SWITCH APPARATUS

RELATED APPLICATIONS

The present patent application is related to co-pending U.S. patent application Ser. No. 10/116,091 filed Apr. 3, 2002 entitled, "Bias Feed Network Arrangement for Balanced Lines," the contents of which are hereby incorporated by reference.

FIELD OF INVENTION

This invention relates to microwave switches and, more particularly, to a high isolation fast state transitioning switch using balanced configurations and switch drivers.

BACKGROUND OF INVENTION

Traditional microwave switches are provided in microstrip (MS) technology or coplanar waveguide (CPW) technology. Certain devices are also used for microwave switches such as the PIN diode, the Schottky diode, and the IMPATT diode, for example. Such diodes are high power switches, however, in many applications high switching speeds are not required. In simplest terms, the most desirable switch would be one that was a short circuit for a first bias condition or closed position, and an open circuit for a reverse bias condition. However, in practice, significant problems arise with microwave switches. In the microstrip or coplanar waveguide technology, the isolation is not as good as desired because the inputs or lines to be switched are not balanced. In the case of coplanar waveguides and microstrips, the input signal and the return signal are not close to one another and therefore there is a great deal of interference and spurious propagation due to radiation effects, resulting in poor isolation between input and output signals.

For high frequency applications (e.g. at millimeter wavelengths), it becomes extremely difficult to implement lumped component based switches that have a switching speed of about 100 picoseconds (pS) with greater than about 25 dB of isolation. One solution involves the use of SRD diodes with Schottky diodes. Basically, a Schottky diode is formed by a deposition of a metal contact on a semiconductor crystal. The Schottky junction diode is a majority carrier device. This implies that there is only a very small stored charge in the junction of the diode as compared with a p-n junction that is a minority carrier device. The SRD diode also performs switching in conjunction with Schottky junctions. These devices are difficult to implement and to provide consistent operation in large scale, large quantity operations. They involve adjustment of many parameters after fabrication to control the switching time. Furthermore, the operating characteristics are inconsistent from device to device and batch to batch. Still further, requirements such as driver switch combinations operative with 100 picosecond (pS) rise time pulses make manufacturing and implementation using the above-identified devices difficult if not impossible.

It is therefore desirable to provide a microwave switch which is capable of high-speed operation and would be further compatible with modern integrated circuit techniques.

SUMMARY OF THE INVENTION

A high speed switching apparatus comprises first and second parallel balanced lines each directed from an input line end to an output line end and spaced apart one from the other and adapted to receive equal and opposite currents to provide balanced operation. Third and fourth parallel balanced lines are spaced apart one from the other and each directed from an input line end to an output line end and adapted to receive equal and opposite currents to provide balanced operation, wherein the input end of the third and fourth lines are separated from the output end of the first and second lines. A first switch is coupled between the output end of the first line and the input end of the third line, and the switch is operative in a first high impedance off state and a second low impedance on state. A second switch is coupled between the output end of said second line and the input end of the fourth line, and the switch is operative in a first high impedance off state and a second low impedance on state. A switch driver is coupled to the first and second switches to operate the switches in the off or on state according to a control signal applied to the driver, whereby when the driver operates the switches in the on state any signal propagating on the first and second lines propagates on the third and fourth lines and when the driver operates the switches in the off state any signal propagating on the first and second lines does not propagate on the third and fourth lines. The first, second, third and fourth lines are each metalized conductive lines located on a semiconductor substrate. In addition, each of the lines has an inductive reactance coupled thereto with a portion of the reactance associated with each line located on a top surface of the substrate, and another portion on a bottom surface of the substrate to provide symmetrical, equal reactive components for each of the lines.

An integrated balanced line microwave switch configuration comprising an input balanced line configuration coupled to an output balanced line configuration via a pair of switching transistors, the switching transistors controlled between a conductive on-state and a non-conductive off-state by means of a switch driver, the switch driver operative with the balanced line configurations to control the transistors between the conductive on-state where the input balanced line configuration is electrically coupled to the output balanced line configuration, thereby enabling a signal to propagate from the input balanced line configuration through the switching transistors to the output line configuration, and the non-conductive off-state where the input balanced line configuration is electrically isolated from the output balanced line configuration, thereby prohibiting a signal to propagate from the input balanced line configuration through the switching transistors to the output line configuration.

BRIEF DESCRIPTION OF THE DRAWINGS

These and other features and advantages of the present invention will be more fully disclosed in, or rendered obvious by, the following detailed description of the invention, which is to be considered together with the accompanying drawings wherein like numbers refer to like parts and further wherein.

DETAILED DESCRIPTION OF THE INVENTION

Figure 1:
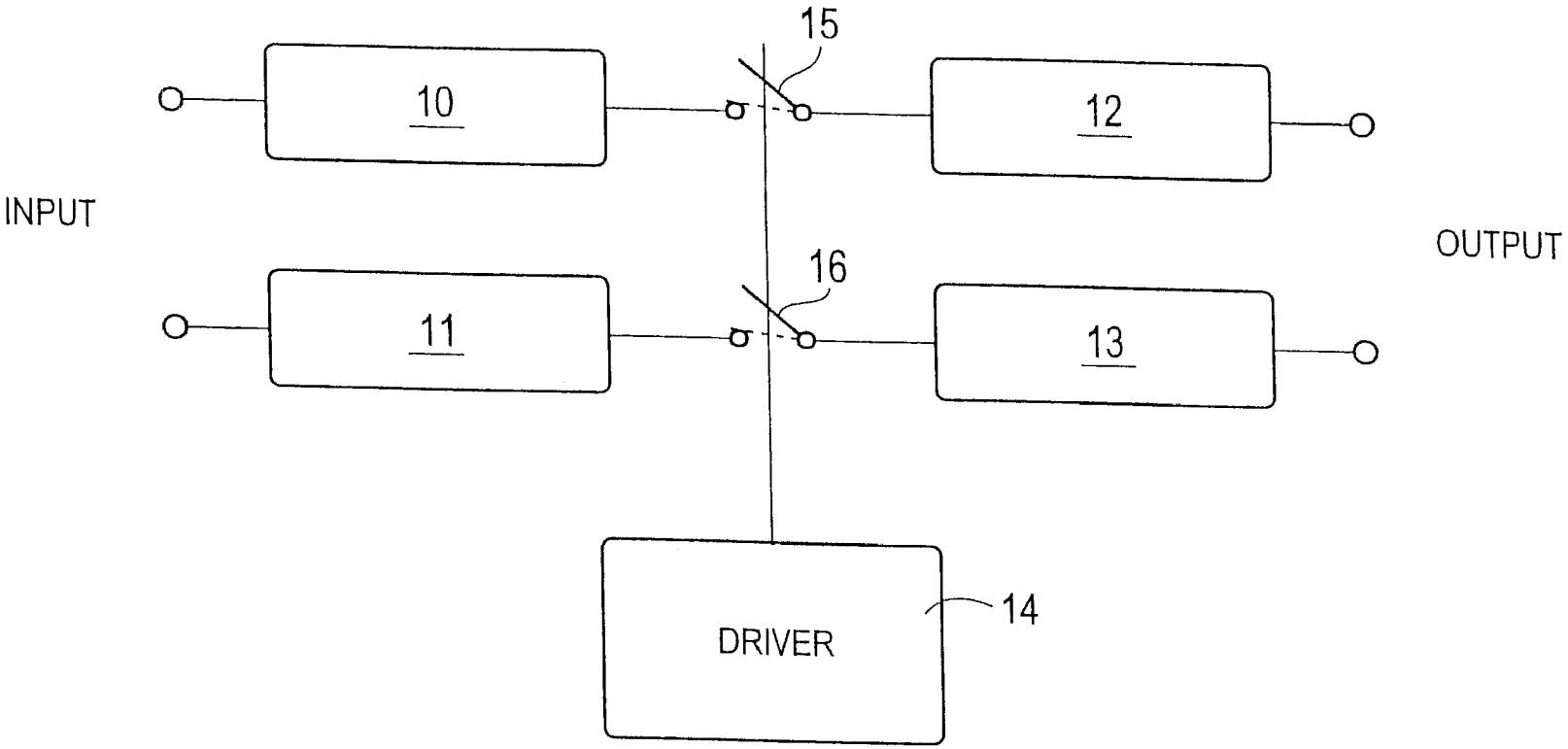
FIG. 1 is a simple block diagram depicting a simple balanced line switch according to an aspect of the invention.

Referring to FIG. 1, there is shown a balanced line switch configuration. Essentially, a balanced line switch consists of balanced input lines 10 and 11 and balanced output lines 12 and 13. The input lines 10 and 11 can be connected to the output lines 12 and 13 through switch devices 15 and 16, which are operated under control of driver 14. Hence, when switches 15 and 16 are in the position (open) shown, there is no connection between the input and output. If the switches 15 and 16 are closed (dashed), then the input lines 10 and 11 are connected to lines 12 and 13. Thus, the signals appearing at the input terminals appear at the output terminals. The switching is under control of the driver 14. In a balanced line configuration, the signals on the lines are extremely close in geometry and have the same amplitude but opposite phase. Due to this fact, the signals flow in opposite directions in lines 10 and 11 and also in lines 12 and 13. Radiation energy is extremely low and there are no spurious or high magnetic fields. Additionally, because the two outer phase signals are relatively close to each other, excitation of spurious modes is low. The switch configuration of FIG. 1 is compared to traditional methods of designing switches based on having an active device on only one of the signal lines. This can be implemented using a Schottky diode, a PIN diode and so on, both of which are conventional devices used in microwave switching devices.

Figure 2:
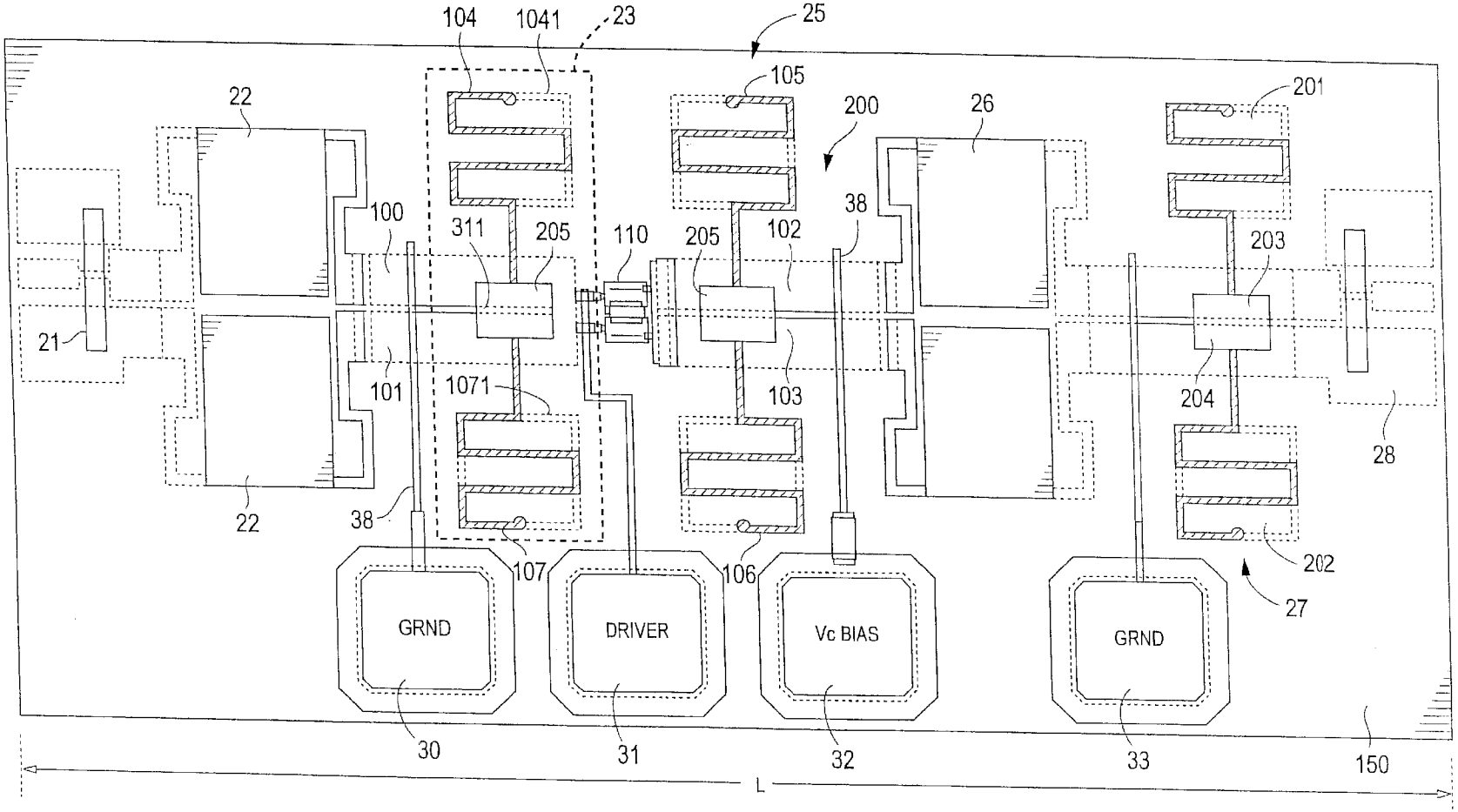
FIG. 2 is a top surface representation of a version of a balanced line circuit formed as an integrated circuit and part of the balanced switch according to an embodiment of the invention.

Referring to FIG. 2, there is shown a top view of a substrate layout of a balanced line configuration and structure according to one aspect of the invention. As seen from top view of the substrate, a (CPW)-to-balanced line transformer 21 is first fabricated. Transformer 21, as indicated, is made to couple a coplanar waveguide (CPW) to a balanced line circuit. Transformation problems in matching a load to a source impedance are important in the microwave frequency range.

Transformers utilized in a coplanar waveguide configuration are well known. The transformer 21 is fabricated using simple underpasses as interconnects, which can be easily fabricated. The transformer 21 is shunted at the output by capacitors 22. The capacitors 22 keep the switch bias isolated from other circuits. Reference numeral 23 refers to a novel biasing circuit which comprises a balanced line circuit.

The balanced line configuration 23 is the subject matter of the above-noted co-pending U.S. application Ser. No. 10/116,091 filed Apr. 3, 2002 entitled, "Bias Feed Network for Balanced Lines", the entire application being incorporated herein by reference. The balanced lines 100 and 101 are metalized on the silicon substrate. The lines 100 and 101 are spaced apart and parallel to one another. The spacing between the lines 100 and 101 constitutes a virtual ground. Each line is associated with an upper and lower serpentine line configuration designated, for example, for line 100 as 104 and 1041, and for line 101 as 107 and 1071. The serpentine lines have, for example, a square wave serpentine pattern and are high impedance devices exhibiting an inductive reactance. The outputs of input lines 100 and 101 are coupled to a pair of bipolar junction transistors (BJT) 110 utilized in a common base configuration. The bipolar junction transistors are of a typical configuration. The emitter of each transistor is coupled to an input line and the bases of the transistors are connected together at the virtual ground 311 which is located between the space of the balanced lines 100 and 101. In a similar manner, there are output lines 102 and 103 which basically have the same configuration as input lines 100 and 101 and which are also associated with corresponding serpentine line configurations 105 and 106.

Figure 8A:
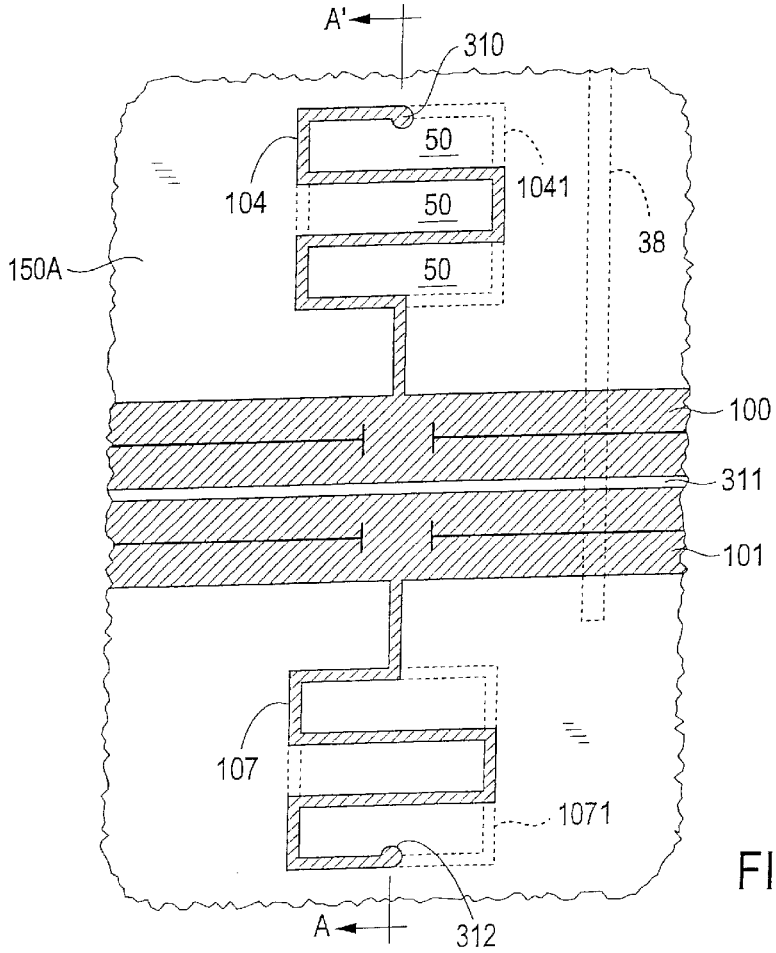
FIGS. 8A, 8B and 8C illustrate detailed top layer, cross-sectional, and bottom layer views, respectively, of a balanced line circuit configuration portion associated with the overall bias circuit structure 200 illustrated in FIG. 2.
Figure 8B:
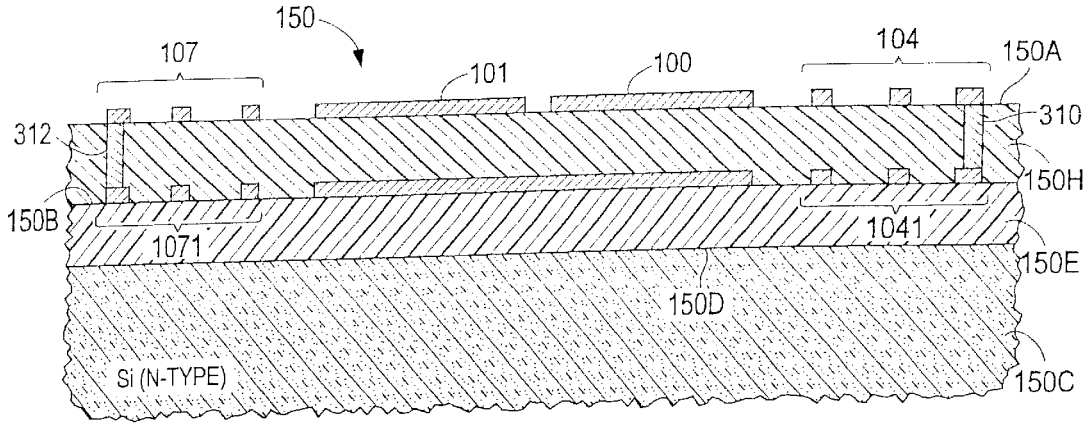
Figure 8C:
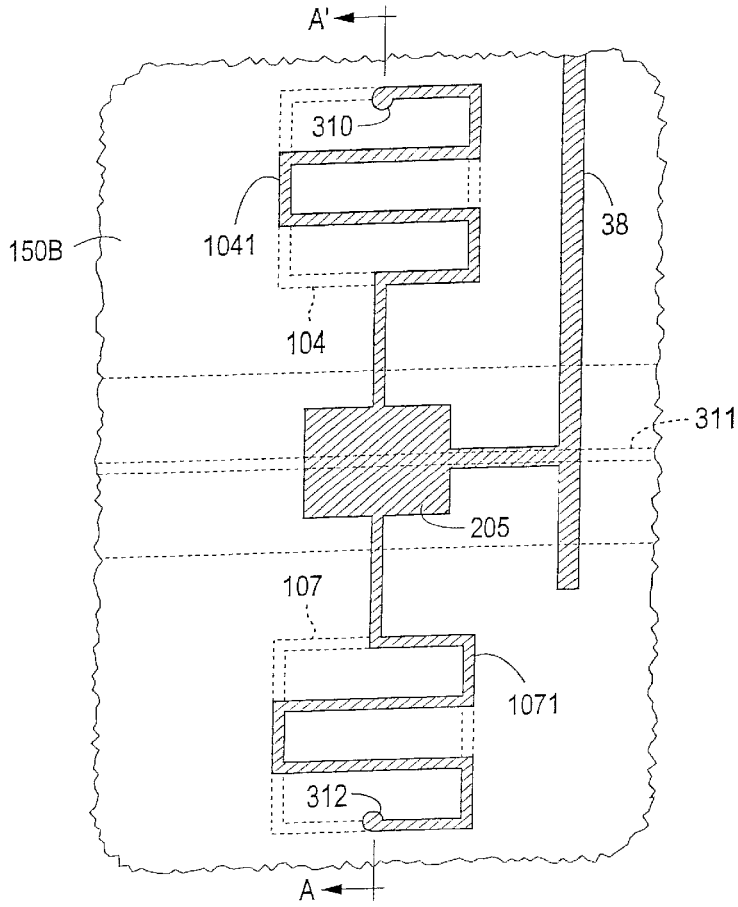

FIGS. 8A, 8B and 8C illustrate detailed top layer, cross-sectional, and bottom layer views, respectively, of a balanced line circuit configuration portion associated with the overall bias circuit structure 200 illustrated in FIG. 2. Referring now to FIG. 8B, there is shown a cross-sectional view along AA' in FIGS. 8A and 8C. Substrate 150 can be fabricated from a semiconductor material such as silicon and essentially comprises a wafer or layer of silicon or other semiconductor material having a top surface 150A, a bottom surface 150B and substrate base 150C. Shown in FIG. 8A is a partial view of the balance line circuit configuration analogous to configuration 23 of FIG. 2 with the balanced line circuit placed on top surface 150A by way of example. It is, of course, understood that the top surface 150A can be interchanged with the bottom surface and there is no particular desired orientation, with the exception that the circuit is balanced and layers are positioned one above the other.

As illustrated in FIG. 8B, substrate base 150C of silicon has a dielectric layer 150E of, for example, $SiO_2$ or SiN, deposited thereon. The layer has a bottom surface 150D and a top surface 150B. Deposited on top of the dielectric layer 150E is another layer 150H of dielectric material of $SiO_2$ or SiN, for example, having top surface 150A. This surface has metal areas formed which include the lines 100 and 101, and serpentine coils 104, 107. Coil 104 is connected to coil 1041 through via 310, while coil 107 is connected to coil 1071 through via 312, on surface 150B. As best seen in FIG. 8A, the two conductive lines designated as 100 and 101 are balanced lines and each line will carry a current in opposite directions or currents that are 180° out of phase. The virtual ground for the circuit is shown at the centerline 311 between the lines 100 and 101. On the top portion of the circuit shown in FIG. 8A, there is a serpentine or sinuous coil configuration 104. Coil configuration 104 has a number of turns shown basically as a square wave type configuration, but any suitable symmetrical configuration can be employed as well. Configuration 104 is basically an inductance, and is electrically coupled or connected to line 100. In a similar manner, a mirror image structure 107, also serpentine in nature, is connected or coupled to line 101.

FIG. 8C is an exemplary illustration of the bottom surface or underlying layer of the substrate below the layer depicted in FIG. 8A. The structure of FIG. 8C does not show transmission lines 100 and 101, but includes a serpentine coil 1041 of a similar configuration to coil 104, but directed in an opposite direction. In a similar manner, the coil 1041 is connected to a central metallic area or pad 205, which is also connected to a corresponding coil 1071, which again is of a similar configuration to coil structure 107. The area 205 is connected to bias line 38, which essentially has a portion directed underneath the virtual ground 311. As shown now in FIGS. 8A and 8C, when the structures are placed on the top layer 150A and the bottom layer 150B of the surface of the substrate, the coils are positioned to overlap one another. The bottom coil portion is connected to the top coil portion by the via to complete the coil configuration. Coil 104 and coil 1041 are connected through via 310 (see FIG. 8A, 8C). Similarly, coil 107 and coil 1071 are also connected through via 312. (See FIG. 8A, 8C). The configuration basically shows three closed rectangular areas, separated one from the other by the substrate. Thus, in FIG. 8A the dashed lines represent, for example, the coil 1071 which is on the bottom surface 150B of the substrate. In a similar manner, as shown in FIG. 8C, the dashed lines represent coil 107, which overlies coil 1071 to form the circuit configuration as shown. As can be seen, virtually the entire top and bottom coils form a closed pattern consisting of three rectangles 50. It is, of course, understood that three is only by way of example. As one can also see from these figures, area 205 is positioned as underlying the central portion of both lines 100 and 101.

The structures shown in FIGS. 8A–8C are implemented on silicon by typical metallization techniques, which include CVD sputtering, electron beam evaporation or other deposition techniques to deposit metal structures on a silicon substrate.

Referring again to FIG. 2, a pair of BJTs 110 in common base configurations correspond to switches 15 and 16 shown in FIG. 1. Lines 10 and 11 of FIG. 1 correspond to lines 100 and 101, while lines 12 and 13 correspond to lines 102 and 103. Reference numeral 25 refers to the biasing circuit or network which is associated with the balanced lines and which is utilized to supply operating voltage to the collectors of the bipolar junction transistors. Reference numeral 26 designates a blocking capacitor which is used to isolate the bias circuit from the output. Reference numeral 27 shows a biasing network used to prevent the propagation of any long-term transients. Reference numeral 28 again shows a balanced line transformer configuration where the balanced transformer has an input balanced line which can be coupled to a coplanar waveguide transformer.

Also seen in FIG. 2 are various metal pads or terminals designated by reference numerals 30, 31, 32 and 33. The control signal for operating the BJT transistors is applied between pad 31 and pad 30, which are designated as GRND1 and Driver. Pad 32 (VC bias) is utilized to apply the operating voltage to the transistors through the balanced line-biasing network, while reference numeral 33 designates a ground terminal (GRND). It is again indicated that the circuit of FIG. 2 has circuitry impressed on multiple layers in accordance with multi layer IC technology. Essentially, the higher level metal is shown in solid lines, while the lower level metal structure is shown in dashed lines. In the embodiment depicted in FIG. 2, the circuit topology is sized on substrate 150 having length L of about 1 millimeter (mm).

Figure 3:
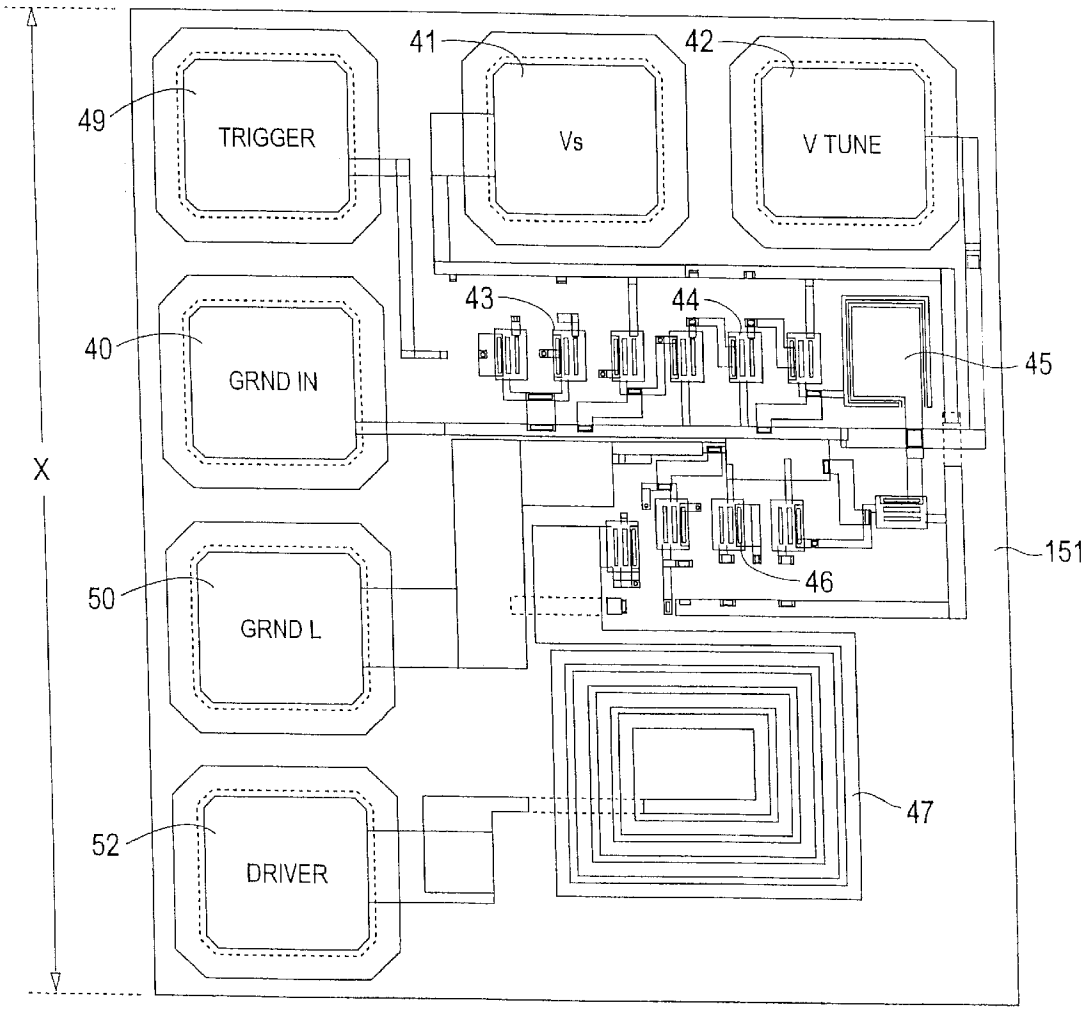
FIG. 3 is a schematic representation of an integrated circuit which will operate as a switch driver for the balanced line circuit of FIG. 2 and part of the balanced switch.

Referring to FIG. 3, there is shown a top lay-out of an embodiment of the switch driver circuit 14 of FIG. 1, and which switch driver, as indicated, controls the BJT devices 110 of FIG. 2. Devices 110 are basically the switches 15 and 16 of FIG. 1. FIG. 3 is a top representation of a substrate formulating a switch driver, as indicated, having length X of about 0.55 millimeter (mm). Reference numeral 49 refers to a pad which receives a trigger input. The trigger input is applied between terminal 49 (trigger) and terminal 40 (Grnd In), which is input ground reference for the trigger input. Terminal 41 is adapted to receive the transistor supply voltage (Vs) for biasing the active components on the substrate. Reference numeral 43 refers to a Schmitt trigger device which operates at a given voltage reference to initiate the generation of a variable length pulse signal. Schmitt trigger devices are well known and there are various well known formats for Schmitt trigger circuits. Such circuits basically utilize a positive feedback loop. The Schmitt trigger is formed by common base and common collector transistors which are typically arranged in a pair. The Schmitt circuit is also analogous to a differential amplifier with a positive feedback loop. Basically, the Schmitt trigger device has two permanent states. In each state, one transistor operates in the common collector configuration while the other is blocked. The state can be changed by a suitable voltage signal applied to the reference input terminal as a trigger. In this way, the trigger can produce a pulse of any desired length depending on the voltage applied to the input of the Schmitt trigger.

Reference numeral 44 depicts circuitry which operates to sharpen the fall and rise time and to offer a low impedance at the output of the Schmitt trigger. The circuit 44 includes an emitter follower stage which provides a high input impedance and a low output impedance. The circuit 44 is followed by an RC delay circuit that triggers the output pulse of about 200 pS to about 1000 pS duration. The voltage at the output of the RC circuit is processed by stage 46, which basically generates a sharp output pulse with a rise and fall time of about 100 pS between the output terminal 52 (Driver) and the output ground terminal 50 (Grnd 1). There is also an inductor 47 which is shown as a spiral loop configuration used to sharpen the rise in the bias current. There is also included a common emitter stage with a level shift to allow for resistance drop in the base of the transistor.

The substrate circuit configurations shown in FIG. 2 and FIG. 3 are easily integrated by well-known circuit techniques. The configurations of FIG. 2 which consist of the balanced lines and biasing circuitry are positioned on the level 1 and level 2 structures of the respective substrate, such as substrate 150 for the balanced line switch and substrate 151 for the switch driver. The substrates 150 and 151 are both fabricated from silicon and, as one can ascertain, silicon is a lossy substrate at high frequencies. It is, of course, understood that the driver circuit of FIG. 3 can be included on the same substrate as the switched line circuit. However, one may employ different devices for the balanced line switches as BJTs and employ HBTs for the Schmitt driver and therefore different substrates may be used. Part of an aspect of the present invention is to enable one to fabricate devices which are compatible with silicon which can operate at high frequencies. For example, the balanced line circuit configurations which are depicted in FIG. 1 and shown in FIG. 2 and FIG. 4 as positioned on silicon wafers are fabricated using metalization techniques to produce the structures, as well as, for example, the terminal areas, such as 31, 32 and 33. In this manner, structures 104, 105, 106 and 107 of FIG. 2, as well as lines 100, 101, 102 and 103 are all provided by metalization. The major portion of the balanced lines is fabricated from inactive devices which are metalized patterns which, because of their structure and positions, are coupled to one another.

There are many techniques which are well known in the art for forming all types of metal components on silicon substrates. Such techniques employ evaporation, beam evaporation, sputtering, and deposition, including CVD. Formation of various elements on substrates is well known in the semiconductor art and such devices, as well as the serpentine line or coil configurations associated with the balanced lines, are fabricated by such well known techniques. See, for example, Chapter 10 of the Electronic Engineer's Handbook edited by Donald Christiansen, fourth edition, published by McGraw Hill & Co., (1997), which discusses material and hardware, including design formats for inductive elements fabricated on substrates, as well as using microstrip, coplanar waveguide configurations. See also text entitled, "Introduction to Microwave Circuits" published by the IEEE Press by Robert J. Weber, (2001), which contains examples of microwave circuits and various techniques for fabricating microwave circuits. It is understood that one of the unique aspects of the present invention is the use of microwave circuits with balanced symmetrical lines to enable efficient fabrication of microwave switches.

Figure 4:
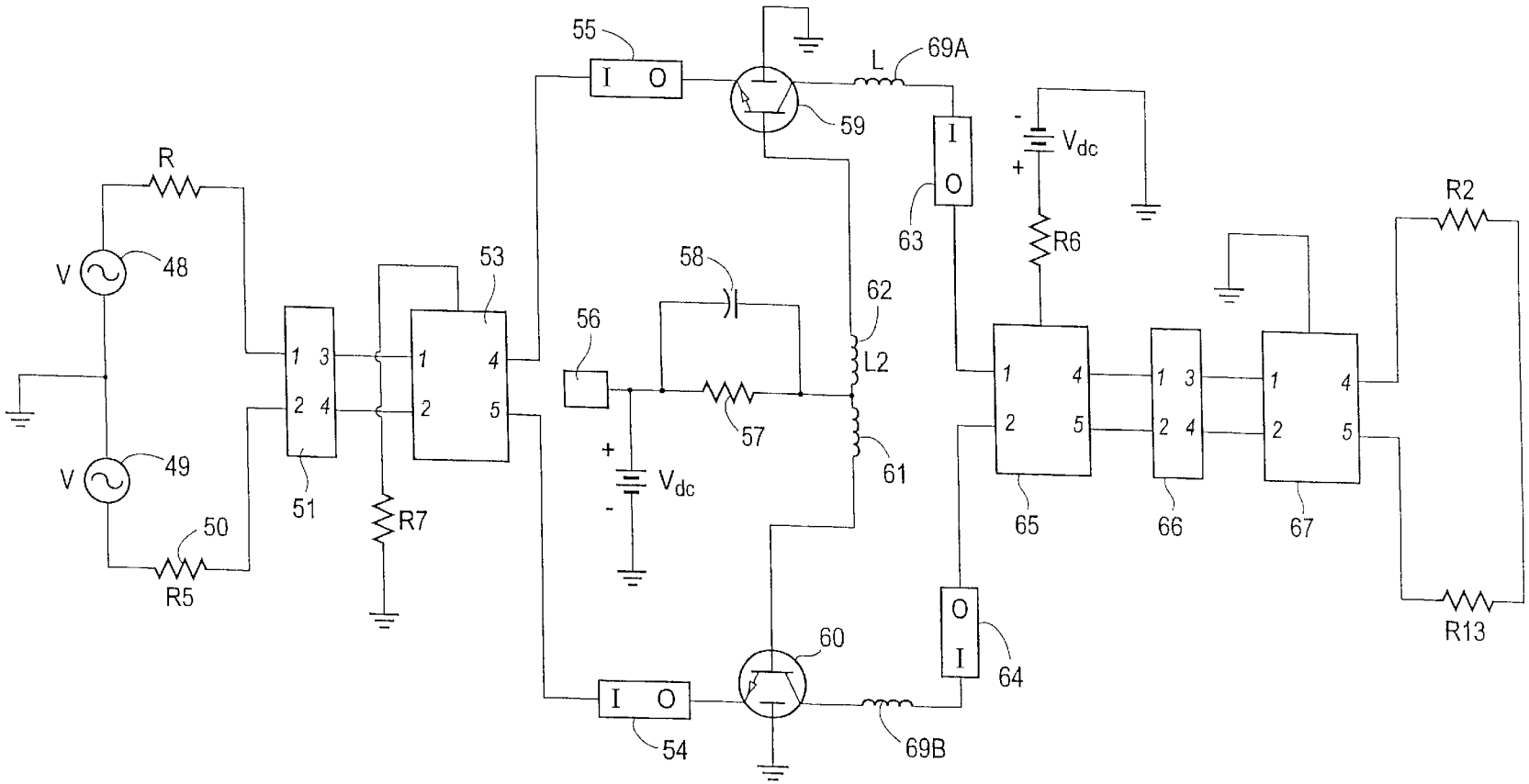
FIG. 4 is a schematic representation of the equivalent circuit of the balanced line circuit according to an embodiment of the invention.

Referring to FIG. 4, there is shown an equivalent circuit of the microwave switch depicted in the topology of FIG. 2. As seen, the input of the microwave switch comprises two out of phase voltage or current generators 49 and 48. These generators are shown by way of example, and operate essentially to produce a differential signal, with one phase applied to line 55 and the opposite phase applied to line 54. The generator signals cause out of phase currents to be provided in each of the resistors 50 and 52. There is shown a network 51 in modular form which is a capacitor network. The series capacitors operate in conjunction with the source resistor 50 and 52 to form a bias network which keeps the switch bias isolated from other circuits. Module 53 refers to the bias network which, as indicated, supplies a bias to the input balanced lines designated as 54 and 55. As explained above, the input balanced lines 54 and 55 are metalized areas on the substrate. There is shown a control terminal 56 (CT), which receives the output of the switch driver. The input terminal 56 is also coupled to a source of potential (V), which is directed through the resistor 57 in shunt with capacitor 58 to the center or virtual ground between inductors 61 and 62. The inductors 61 and 62 represent the base feed lines for the BJTs or HBTs. These inductors are coupled to the base electrodes of an associated bipolar junction transistor (BJT) transistor 59 and 60. As can be seen, transistor 59, which is a BJT has its emitter electrode coupled to the output (O) of line 55 while BJT 60 has its emitter electrode coupled to the output (O) of line 54. Transistors 59 and 60 are basically the switches 15 and 16 of FIG. 1. When a positive bias is applied to the base electrode, the transistors conduct to cause the output (O) of the lines 54 and 55 to be directed to the input (I) of lines 64 and 63. As seen, lines 64 and 63 are coupled to the collector electrodes of the BJT transistors 59 and 60. The inductors 69A and 69B represent the out inductance at the collector of the BJT. The output (O) of each line 63, 64 is directed into a module 65, which again is a biasing network identical to module 53 and also coupled to a bias source through a resistor. This supplies biasing voltage for the collector electrodes of the BJTs, while the biasing network 53 supplies biasing potential for the emitters of the BJTs. The biasing networks are symmetrically balanced circuits which use balanced lines and which have an isolated virtual ground which is separated from the actual ground to produce a minimum of interference. Interference is often significant in switching circuits, as switching transients can cause havoc at high frequencies. In this circuit, transients that appear are equal and opposite in direction because of the use of the balanced line and symmetrical circuit configurations. These switching transients do not affect circuit operation. The output of the biasing network is coupled to a balanced line to CPW transformer, which enables on-line testing.

As one can ascertain from the substrate shown in FIG. 4, the output circuit comprises a single balanced line configuration where each of the lines includes inductor configurations 201 and 202 (see FIG. 2), which are coupled to respective balanced lines 203 and 204, and which are positioned on the substrate on different metalization levels. The bottom level of the substrate has metalized pads as 205 to perform capacitive coupling.

Figure 5:
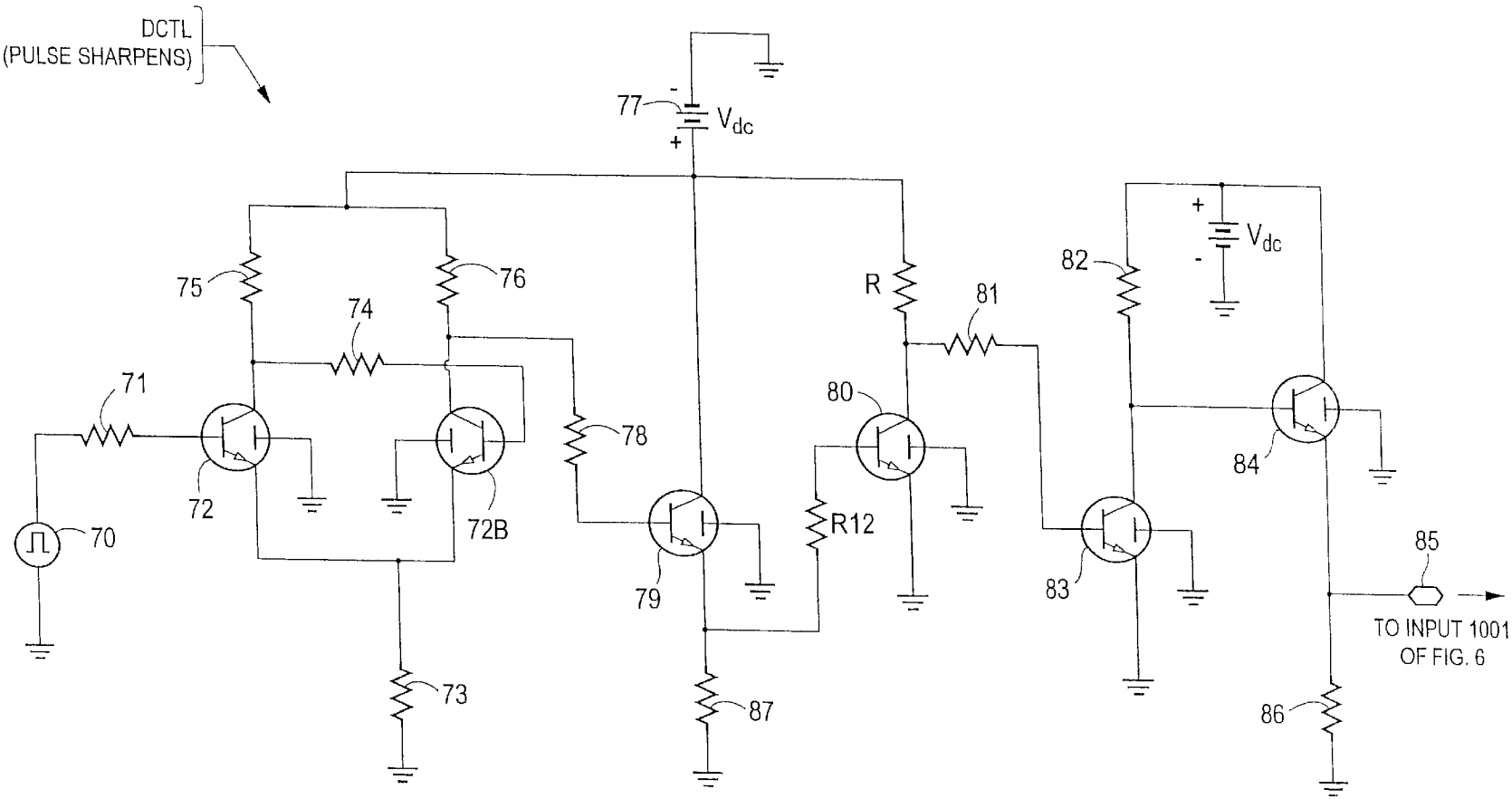
FIG. 5 is a schematic representation of the equivalent circuit of a part of the switch driver according to an embodiment of the invention.

Referring to FIG. 5, there is shown a version of a part of the switch driver according to this invention having the topology as shown in FIG. 3. Essentially, the switch driver, as indicated, includes a pulse generator 70 or pulse input terminal, which is directed through a resistor 71 to a base electrode of a first bipolar junction transistor 72. In the case of the Schmitt trigger, which is shown in FIG. 5, the bipolar transistor 72 can also be a heterojunction bipolar transistor (HBT). As can be seen, the Schmitt trigger is arranged in a differential amplifier configuration, where the trigger has a common return resistor 73 which is connected to the emitter electrodes of transistors 72 and 72B. Both transistors 72 and 72B have a common emitter return to ground. The transistor 72B has its gate electrode coupled to the collector electrode of transistor 72 through a resistor 74. The collector electrode of transistor 72 is connected to a point of bias potential (e.g. battery) 77 through collector resistor 75. The collector of transistor 72B is also connected to the source of potential 77 through resistor 76. As seen, the circuit consisting of transistor 72 and 72B is a Schmitt trigger with positive feedback from the collector electrode of transistor 72 to the base electrode of transistor 72B via resistor 74. The Schmitt trigger operates so that each time a pulse of a certain magnitude appears at terminal 70, the Schmitt trigger changes state and then reverts back to the first state when the voltage decreases below the trigger line. In this manner, the Schmitt trigger can convert the pulses from generator 70 into sharper, narrower pulses. The output of collector electrode transistor 72B is directed to the input of an emitter follower, including transistor 79. The emitter follower presents a high input impedance for the Schmitt trigger and a low output impedance. The emitter electrode of transistor 79 is coupled to the base electrode of transistor 79 through resistor 78. The emitter electrode of transistor 79 is connected to ground through a resistor 87. The collector electrode of transistor 79 is connected to the biasing source 77. The collector electrode of transistor 80 is coupled via resistor 81 to the base electrode of transistor 83. Transistor 83 is an amplifier having a collector load resistor 82. The collector electrode of the transistor 83 is directly connected to the base electrode of a common emitter output amplifier 84 whose emitter electrode is connected to ground via resistor 86 and which provides a low impedance output at terminal pad 85. Terminal pad 85 is coupled to input 1001 of FIG. 6.

Figure 6:
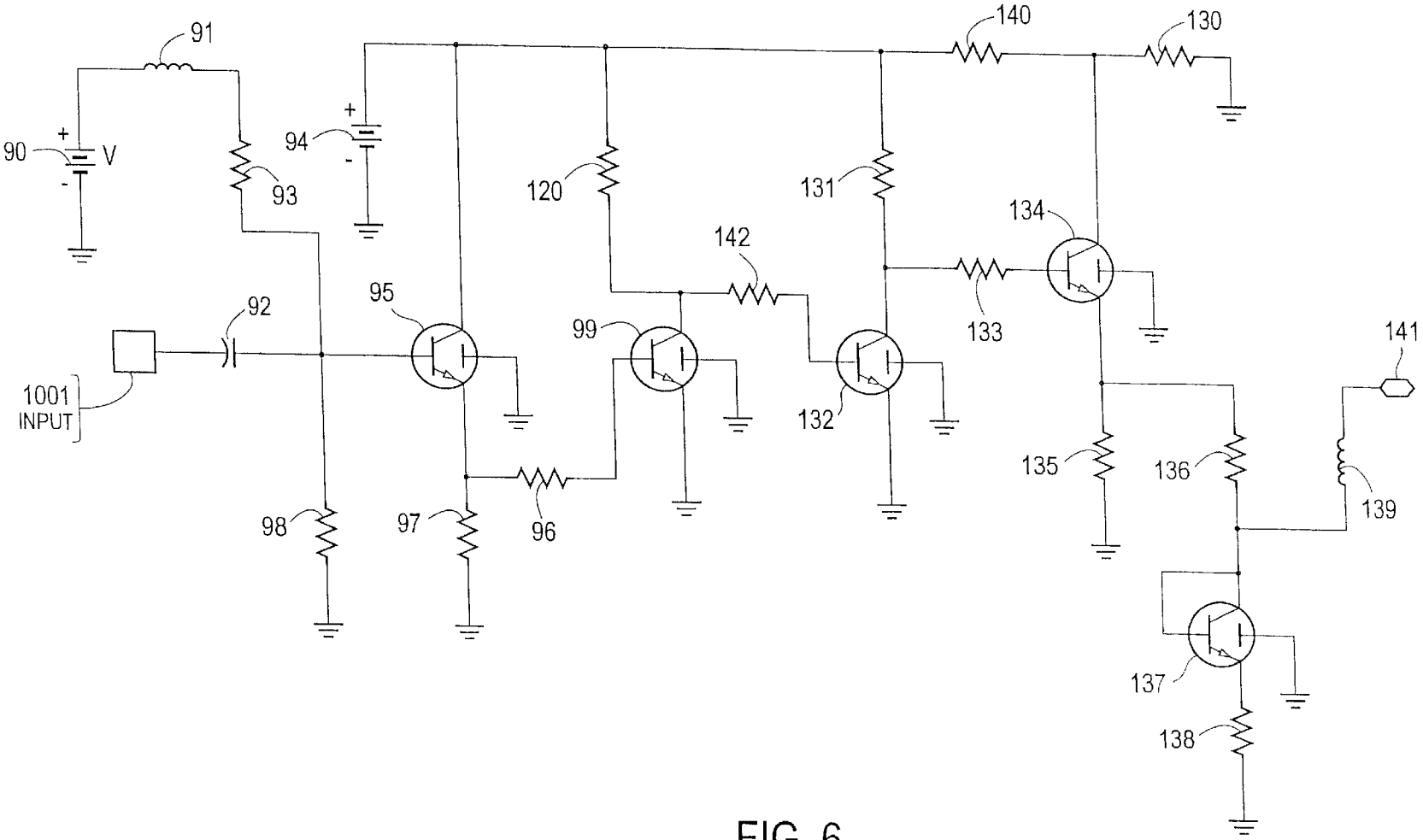
FIG. 6 is a schematic representation of the equivalent circuit of a part of the switch driver following that of FIG. 5.

Referring to FIG. 6, there is shown a switch driver circuit enhancer which is utilized to further shape the pulse. In FIG. 6, there is a source of potential 90, which is directed through an inductor 91 in series with a resistor 93 to one terminal of a capacitor 92. The other terminal of capacitor 92 is connected to an input pad (INPUT) 1001 which is coupled to the output of output terminal 85 of FIG. 5. In this manner, the output of the Schmitt trigger is received at INPUT 1001 and is coupled through the capacitor 92, which has one terminal coupled to ground via resistor 98, thus forming an integrator circuit. The circuit sharpens the pulse edges. By varying the DC voltage of source 90, one can now vary the pulse duration of the pulse output of the Schmitt trigger. This sharpened pulse is applied to the base electrode of an emitter follower, including transistor 95, having its emitter coupled to ground via resistor 97. The emitter of transistor 95 is coupled through resistor 96 to the base of an amplifier configuration, including transistor 99. Transistor 99 has a collector load resistor 120. The collector is coupled through resistor 142 to the base electrode of an additional transistor 132. The collector electrode of transistor 132 is coupled to reference potential through resistor 131. The collector electrode of transistor 132 is coupled through resistor 133 to the base electrode of transistor 134, arranged as an emitter follower. The emitter of transistor 134 is coupled to ground via a resistor 135. The emitter of transistor 134 is also coupled via a current limiting resistor 136 to a transistor 137 arranged as a diode having the collector connected to the base and having a resistor 138 in its emitter electrode. Transistor 137 acts as a constant current source. The circuit output is coupled to an inductor 139 and then to a pad 141. In this manner, the pad 141 can also be directed to the terminal 56 of FIG. 4 to produce a faster switching pulse for the balanced line switch. This essentially enables the switching of transistors 59 and 60 under control of the switch driver shown in FIG. 5. It is also understood that the pulse, which is developed in generator 70, can only be applied as is well known in the arts when switching is to take place and can be under control of another device such as a processor, for example.

Figure 7:
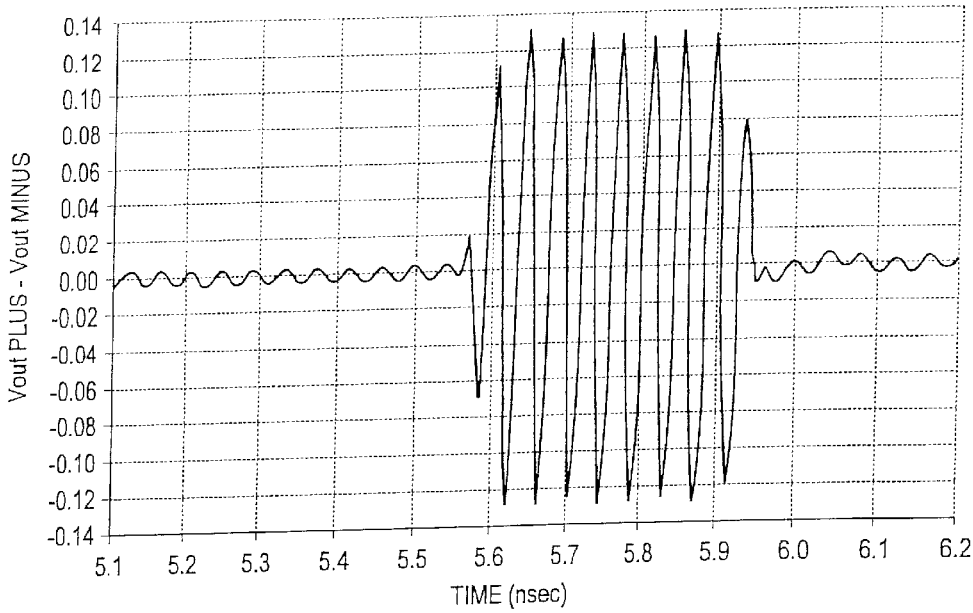
FIG. 7 is a graph depicting voltage versus time to show the switch driver switching waveform.

FIG. 7 shows the driver switching waveform. Essentially the waveform of FIG. 7 basically depicts the output of the switch driver circuits shown in FIGS. 5 and 6 as applied to the gate electrodes of transistors 59 and 60 (FIG. 4) to provide switching of the input and output balanced lines.

FIG. 7 basically depicts a graph of the pulse generated by the driver switch when the VTUNE voltage is 2 volts. The simulated rise time of the RF transient is less than 100 pS. The simulated isolation of the switch from the on to off state is better than 25 dB.

Thus, by the use of balanced line switching one achieves high isolation across a broad bandwidth. Coupling from the lossy silicon substrate is eliminated because the balanced lines cancel the current induced in the substrate. The biasing circuit and networks are included to reduce the transients. The DC ground beyond the collector of the transistor reduces any long-term DC transient although short-term DC transients may be present. The switch is fabricated from amplifier type building blocks that allow for mismatch and still operate reasonably from the point of noise and power point of view. The circuit has about 0 dB insertion loss. Therefore, the requirement of matching is eliminated and therefore the circuit size is small and better matching performance can be obtained. The switch, as shown, is usable for many other components, such as amplifiers, multipliers, oscillators and mixers, as one has to provide a good match and/or feedback with the accompanying bias circuit. All these aspects are easy to achieve with the balanced line configuration shown. The circuits shown above are used for fast switching. Due to the inherently matched silicon HBTs or BJTs, which can be used in both the switch and the driver, the temperature dependence of the output waveform is low. The driver, as indicated, has very sharp rise and fall time due to the shaping or enhancer sections and the emitter followers. As indicated, the last stage of the driver is spiked by an inductor 139 that basically resonates the bipolar capacitance and yields a very sharp rise time pulse (FIG. 7). The pulse duration of the drivers is controlled by the RC charging time constants of the circuits. Additionally, the ground of the driver is routed with the pulse signal whereby a true reference ground voltage is fed into the switch, allowing fast transient operation. As indicated, bipolar transistors can also be employed in these devices. A bipolar device can be built from a single type of semiconductor, such as silicon, with the emitter base and collector regions having different doping levels and types that all are in a silicon wafer.

It is also understood that other types of bipolar transistors can employ different semiconductor compositions for the emitter base or the emitter base and the base and collector, or the base and collector regions. The emitter, for example, may be fabricated from a wider band gap material than the base. For example, one can use AlGaAs for the emitter and GaAs for the base. Further, any 3-terminal transistor service such as FET, MOSFET, PHEMT or any other fast switching device may be used. Thus, there are great advantages in providing high switching rates using silicon-BJT or Silicon Germanium (SiGe HBT) HBT technology which further employs balanced line circuits and balanced biasing circuits, including symmetrical switch configurations.

It should therefore be understood that the embodiments and variations shown and described herein are illustrative and that various modifications may be implemented without departing from the scope of the invention.

What is claimed is:

1. A high speed switching apparatus, comprising:

first and second parallel balanced lines each directed from an input line end to an output line end and spaced apart one from the other and adapted to receive equal and opposite currents to provide balanced operation, third and fourth parallel balanced lines spaced apart one from the other and each directed from an input line end to an output line end and adapted to receive equal and opposite currents to provide balanced operation, said input end of said third and fourth lines separated from said output end of said first and second lines, a first switch coupled between said output end of said first line and said input end of said third line, said switch operative in a first high impedance off state and a second low impedance on state, a second switch coupled between said output end of said second line and said input end of said fourth line, said switch operative in a first high impedance off state and a second low impedance on state, a switch driver coupled to said first and second switches to operate said switches in said off or on state according to a control signal applied to said driver, whereby when said driver operates said switches in said on state any signal propagating on said first and second lines propagates on said third and fourth lines and when said driver operates said switches in said off state any signal propagating on said first and second lines does not propagate on said third and fourth lines.

2. The high speed switching apparatus according to claim 1 wherein said first, second, third and fourth lines are each metalized conductive lines located on a semiconductor substrate.

3. The high speed switching apparatus according to claim 2 wherein said substrate is silicon.

4. The high speed switching apparatus according to claim 2 wherein said first and second lines have a bias network coupled thereto.

5. The high speed switching apparatus according to claim 4 wherein said third and fourth lines have a bias network coupled thereto.

6. The high speed switching apparatus according to claim 5 wherein said first and second switches are first and second transistors, each having a base, collector and emitter electrode with the emitter electrode of said first transistor coupled to the output of said first line, and with the emitter electrode of said second transistor coupled to the output of said second line, with the collector electrode of said first transistor coupled to the input of said third line and with the collector electrode of said second transistor coupled to the input of said fourth line, and with the base electrodes of said first and second transistors coupled to said switch driver for operating said transistors via said base in a conducting on state or a non-conducting off state.

7. The high speed switching apparatus according to claim 6 wherein said transistors are bipolar junction transistors.

8. The high speed switching apparatus according to claim 6 wherein said transistors are heterojunction bipolar transistors.

9. The high speed switching apparatus according to claim 4 wherein each of said lines has an inductive reactance coupled thereto with a portion of said reactance associated with each line located on a top surface of said substrate, and another portion on a bottom surface of said substrate to provide symmetrical, equal reactive components for each of said lines.

10. The high speed switching apparatus according to claim 1 wherein said switch driver includes a Schmitt trigger circuit having first and second transistors each having a base, collector and emitter electrode, with the collector electrode of said first transistor coupled via a first resistor to the base electrode of said second transistor, with the emitter electrode of said first and second transistor coupled together and directed towards a source of reference potential through a second resistor with the collector electrodes of said first and second transistors coupled through associated resistors to a source of operating potential, with said base of said first transistor adapted to receive a pulse trigger to cause said Schmitt trigger to transition states to provide at the collector electrode of said second transistor a narrower pulse having decreased rise and fall times as compared to those of said pulse trigger.

11. The high speed switching apparatus according to claim 10 wherein said first and second transistors are heterojunction bipolar transistors.

12. The high speed switching apparatus according to claim 10 wherein said first and second transistors are bipolar junction transistors.

13. The high speed switching apparatus according to claim 10 wherein said first and second transistors are formed on a semiconductor substrate.

14. The high speed switching apparatus according to claim 13 wherein said substrate is silicon.

15. The high speed switching apparatus according to claim 10 further including an amplifier coupled to said collector electrode of said second transistor to provide at an output said amplified narrower pulse.

16. The high speed switching apparatus according to claim 1 wherein said switch has an isolation between said outputs of said first and second lines said inputs of said third and fourth lines when said switches are in said off state of at least 20 dB.

17. The high speed switching apparatus according to claim 10 wherein said output of said Schmitt trigger provides an adjustable duration pulse.

18. The high speed switching apparatus according to claim 1 wherein said output pulse of said Schmitt trigger has a rise time ranging from about 10 pS to about 200 pS.

19. The high speed switching apparatus according to claim 17 wherein said pulse duration is determined by a RC circuit coupled to said output of said Schmitt trigger.

20. The high speed switching apparatus according to claim 1 further including a balanced line transformer coupled to the outputs of said third and fourth lines.

21. An integrated balanced line microwave switch configuration comprising:

an input balanced line configuration coupled to an output balanced line configuration via a pair of switching transistors, the switching transistors controlled between a conductive on-state and a non-conductive off-state by means of a switch driver, the switch driver operative with the balanced line configurations to control the transistors between the conductive on-state where the input balanced line configuration is electrically coupled to the output balanced line configuration, thereby enabling a signal to propagate from the input balanced line configuration through the switching transistors to the output line configuration, and the non-conductive off-state where the where the input balanced line configuration is electrically isolated from the output balanced line configuration, thereby prohibiting a signal to propagate from the input balanced line configuration through the switching transistors to the output line configuration.

22. The switch configuration of claim 21, wherein the input balanced line configuration comprises first and second parallel balanced lines each directed from an input line end to an output line end and spaced apart one from the other and adapted to receive equal and opposite currents to provide balanced operation.

23. The switch configuration of claim 22, wherein the output balanced line configuration comprises third and fourth parallel balanced lines spaced apart one from the other and each directed from an input line end to an output line end and adapted to receive equal and opposite currents to provide balanced operation.

* * * * *